US008538306B2

(12) United States Patent
Yang et al.

(10) Patent No.: US 8,538,306 B2
(45) Date of Patent: Sep. 17, 2013

(54) WEB FEED SYSTEM HAVING COMPENSATION ROLL

(75) Inventors: Ming Yang, Fairport, NY (US); Roger G. Leighton, Hilton, NY (US); Frank Albert Porter, Penfield, NY (US); Carlos Manuel Terrero, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 322 days.

(21) Appl. No.: 13/113,129

(22) Filed: May 23, 2011

(65) Prior Publication Data

US 2012/0301186 A1 Nov. 29, 2012

(51) Int. Cl.
*G03G 15/16* (2006.01)
*G03G 15/00* (2006.01)

(52) U.S. Cl.
USPC ..... 399/317; 399/384

(58) Field of Classification Search
USPC ..... 399/66, 121, 317, 384
See application file for complete search history.

(56) References Cited

U.S. PATENT DOCUMENTS 4,017,065 A 4/1977 Poehlein
4,785,325 A 11/1988 Kramer et al.
4,905,052 A 2/1990 Cassano et al.
5,294,965 A 3/1994 May
5,481,352 A * 1/1996 Yamamoto et al. ..... 399/384
5,732,315 A * 3/1998 Inoue et al. ..... 399/317
5,848,345 A * 12/1998 Stemmle ..... 399/384 X
5,860,053 A * 1/1999 Stemmle ..... 399/384
5,875,383 A * 2/1999 Stemmle ..... 399/384
5,878,320 A 3/1999 Stemmle
5,970,304 A 10/1999 Stemmle
6,032,004 A 2/2000 Mirabella, Jr. et al.

OTHER PUBLICATIONS

U.S. Appl. No. 13/073,403, Kenneth P. Moore et al., filed Mar. 28, 2011.

* cited by examiner

*Primary Examiner* — Sandra Brase
(74) *Attorney, Agent, or Firm* — Gibb & Riley, LLC

(57) ABSTRACT

An apparatus includes a photoreceptor belt, a fixed transfer roller positioned on the inside of the photoreceptor belt, and a movable transfer roller positioned on the outside of the photoreceptor belt. The fixed transfer roller and the movable transfer roller are positioned to form a nip, and the photoreceptor belt and a web of print media are positioned in the nip. Also, a support roller and a compensation roller contact the web of print media. The support roller is positioned between the compensation roller and the nip. A physical link is connected to the support roller and the compensation roller. The physical link moves the support roller and the compensation roller so as to keep a constant tension on the web of print media.

20 Claims, 3 Drawing Sheets

WEB FEED SYSTEM HAVING COMPENSATION ROLL

BACKGROUND

Embodiments herein generally relate to a web feed system in a printing device, and more particularly to a web feed system that includes a compensation roll that keeps a constant tension on the web of print media as the movable transfer roller moves relative to the photoreceptor belt.

Contiguous label presses require the marriage of the photoreceptor continuous polyimide belt with a label stock (paper release/paper label or polymer release/polymer label) open loop web. The transfer of the image from the photoreceptor belt to the paper occurs at the fixed transfer roller along the photoreceptor belt. The photoreceptor belt has a seam that cannot be imaged. Therefore, a periodic retraction/engagement-disengagement of the web is necessary to skip the seam. This requires the paper to reverse and be reengaged to maintain a uniform gap label pitch between labels. Otherwise, a significant amount of waste would occur in the final label product stream. When the web is retracted by disengaging the biased (moveable) transfer roll from the fixed photoreceptor transfer roll, the web length changes and this can lead to high web tension changes, which can cause motion quality and image registration errors. This error can make the product unacceptable in the market due to poor image quality.

SUMMARY

The following describes a simple and low-cost device that can automate tension compensation when a media web is retracted from a photoreceptor. In this disclosure, a compensational roll is hard linked with a biased (moveable) transfer roll. Thus, whenever the biased transfer roll is disengaged from the photoreceptor transfer roll, the web slack generated by the biased transfer roll movement is compensated by the movement of the compensation roll so that ultimately no slack is generated on the web and the constant web tension is maintained.

An exemplary apparatus herein includes a photoreceptor belt having a seam, a fixed transfer roller positioned on the inside (on a "first" side) of the photoreceptor belt, and a movable transfer roller positioned on the outside of the photoreceptor belt (on a "second" side of the photoreceptor belt that is opposite the first side). The fixed transfer roller and the movable transfer roller are positioned to form a nip, and the photoreceptor belt and a web of print media are positioned in the nip.

Further, an actuator is connected to the movable transfer roller. The actuator selectively moves the movable transfer roller to open the nip when the seam of the photoreceptor belt passes through the nip. Also, a support roller and a compensation roller contact the web of print media. The support roller is positioned between the compensation roller and the nip. A cam can be used to cause the support roller to move when the actuator moves the movable transfer roller.

A physical link is connected to the support roller and the compensation roller. The physical link moves the compensation roller with the support roller so as to keep constant tension on the web of print media as the movable transfer roller moves relative to the photoreceptor belt. In some embodiments, the physical link can also be connected to the movable transfer roller, eliminating the need for the cam. Alternatively, a second actuator can be connected to the physical link or the support roller, again eliminating the need for the cam.

Additionally, the support roller can be approximately centered between the compensation roller and the nip, the support roller and the compensation roller can be approximately the same size, and the support roller and the compensation roller can be positioned on opposite sides of the web of print media.

These and other features are described in, or are apparent from, the following detailed description.

BRIEF DESCRIPTION OF THE DRAWINGS

Various exemplary embodiments are described in detail below, with reference to the attached drawing figures, in which.

DETAILED DESCRIPTION

A goal of the label web press industry is to print a continuous stream of labels with a constant gap between labels. This gap could be as small as 3 mm. However, a skip pitch problem arises due to the photoreceptor belt seam. To eliminate excessive material waste due to the photoreceptor seam, the web periodically retracts via a movement that is sometimes referred to as a "pilgrim step" movement. In the pilgrim step, the biased transfer roll is disengaged from the photoreceptor belt, decelerated, reversed, accelerated, and then reengaged to the photoreceptor belt so that the seam will not be "printed" on the web. This coordinated motion ensures that the gap is constant between labels. The goal of the pilgrim step registration is the industry standard of +150 um in both process and cross track directions. In order to achieve the registration careful control of the tension is essential. The embodiments described below address the tension control by keeping the web span lengths the same during the pilgrim step motion.

Figure 1:
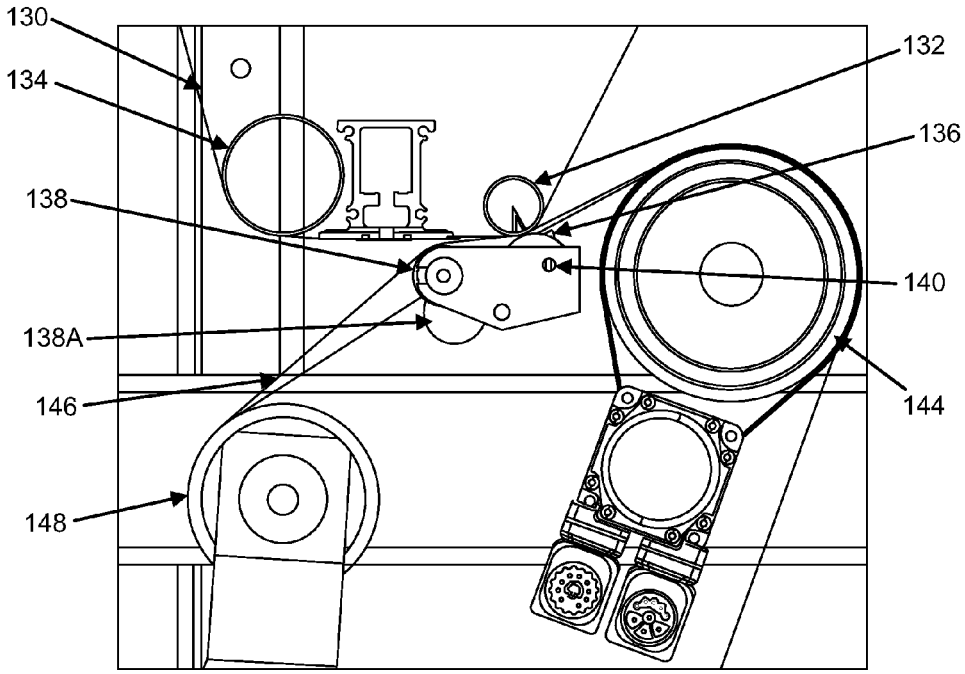
FIG. 1 is a side-view schematic diagram of a device according to embodiments herein.

One current configuration is shown in FIG. 1, which includes a photoreceptor belt 130 which is supported by various rolls (which are sometimes referred to herein as "rollers") including a driver roller 134 and a fixed transfer roller 132. The web of print media 146 is similarly supported by various rollers, including an idler roller 148, a support roller 138, a biased movable transfer roller 136, and a vacuum pull roller 144. During the pilgrim step movement the biased movable transfer roller 136 moves away from the photoreceptor 130 and the fixed transfer roller 132 and a cam 140 causes the support roller to move from position 138 to position 138A. Whenever the web 146 is retracted in the pilgrim step movement, the web 146 becomes slacked due to length change.

The web tension is hard to control because of the speed at which the retract and engage occur (within approximately 30 to 40 ms). More specifically, the speed at which the cam 140 mechanism engages and retracts may create unmanageable tension variations leading to poor web registration during the pilgrim step motion. Additionally, it is difficult, if not impossible, to prevent tension variation during the pilgrim step movement by only changing the servo timing. The various structures herein address the tension control issues by maintaining equal length spans in both engaged and disengaged positions. Another feature of the designs presented herein is that they avoid any wrapping of the label stock web on the biased transfer roll foam roller 136 that could provide nip instability during steady state printing.

Therefore, as shown in FIGS. 2-5, a tension compensation roller 160 is hard linked and pivoted together with the biased movable transfer roller 136 and the support roller 142. A physical link 164 causes the compensation roller 160 and support roller 142 to move together so the net web length is equal in both the engage and disengage movements. The physical link 164 moves the compensation roller 160 with the support roller 142 so as to keep a constant tension on the web of print media 146 as the movable transfer roller 136 moves relative to the photoreceptor belt 130.

More specifically, FIGS. 2-5 show a similar structure as is illustrated in FIG. 1, with some elements removed to more clearly illustrate the features herein. In these Figures, a fixed transfer roller 132 is positioned on the inside (on a "first" side) of the photoreceptor belt 130, and a movable transfer roller 136 positioned on the outside of the photoreceptor belt 130 (on a "second" side of the photoreceptor belt 130 that is opposite the first side). The fixed transfer roller 132 and the movable transfer roller 136 are positioned to form a nip 150, and the photoreceptor belt 130 and the web of print media 146 are positioned in the nip 150.

Further, an actuator 152 is connected to the movable transfer roller 136. The actuator 152 selectively moves the movable transfer roller 136 to open the nip 150 when the seam 154 of the photoreceptor belt 130 passes through the nip 150. The cam 140 can be used to cause the support roller 142 to move when the actuator 152 moves the movable transfer roller 136.

The support roller 142 and compensation roller 160 contact the web of print media 146 and are positioned on either the same side or the opposite sides of the web of print media 146 depending on the tension compensation requirement. In this example, the support roller 142 is positioned on the inside (first side) of the web of print media 146, and the compensation roller 160 is positioned on the outside (second side) of the web of print media 146. The support roller 142 is positioned between the compensation roller 160 and the nip 150. Additionally, the support roller 142 can be approximately centered between the compensation roller 160 and the nip 150, and the support roller 142 and the compensation roller 160 can be approximately the same size.

Figure 2:
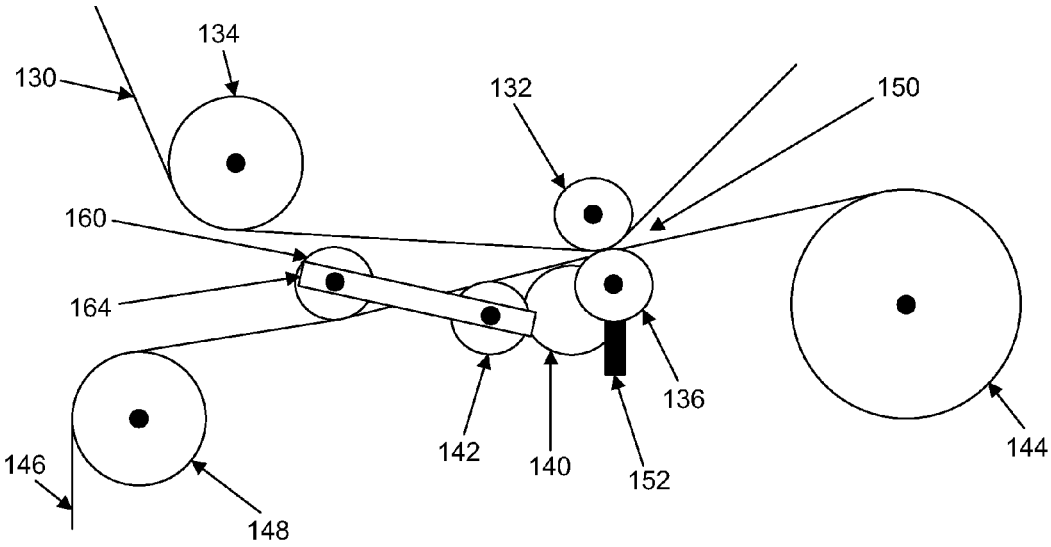
FIG. 2 is a side-view schematic diagram of a device according to embodiments herein.
Figure 3:
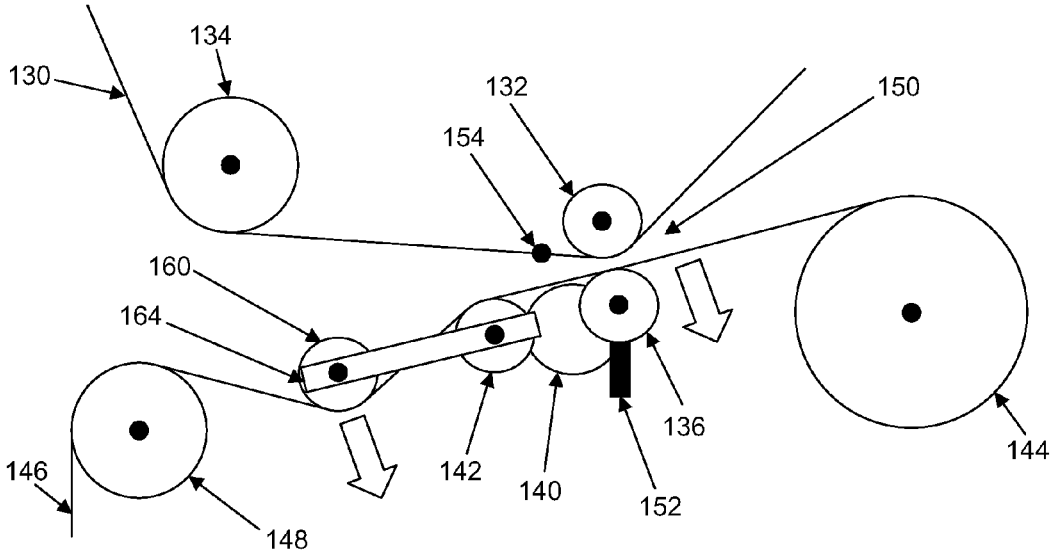
FIG. 3 is a side-view schematic diagram of a device according to embodiments herein.

As shown in FIG. 2 for example, during normal operation (when the biased movable transfer roller 136 is engaged with the photoreceptor transfer roll) the tension compensation roller 160 may only lightly touch the web of print media 146. However, as shown in FIG. 3, when the photoreceptor seam 154 needs to pass through the nip 150 and the biased movable transfer roller 136 is pivoted or moved away from the fixed transfer roller 132, the tension compensation roller 160 is engaged more with the web.

The compensation roller 160 is designed so that the web length is constant or near constant even though the compensation roller 160 and the biased movable transfer roller 136 are moved/pivoted. This allows the web tension to remain constant (or near constant) even as the movable transfer roller 136 is moved. Thus, FIG. 3 demonstrates that embodiments herein provide a structure that keeps a constant tension on the web of print media 146 as the movable transfer roller 136 moves relative to the photoreceptor belt 130.

Figure 4:
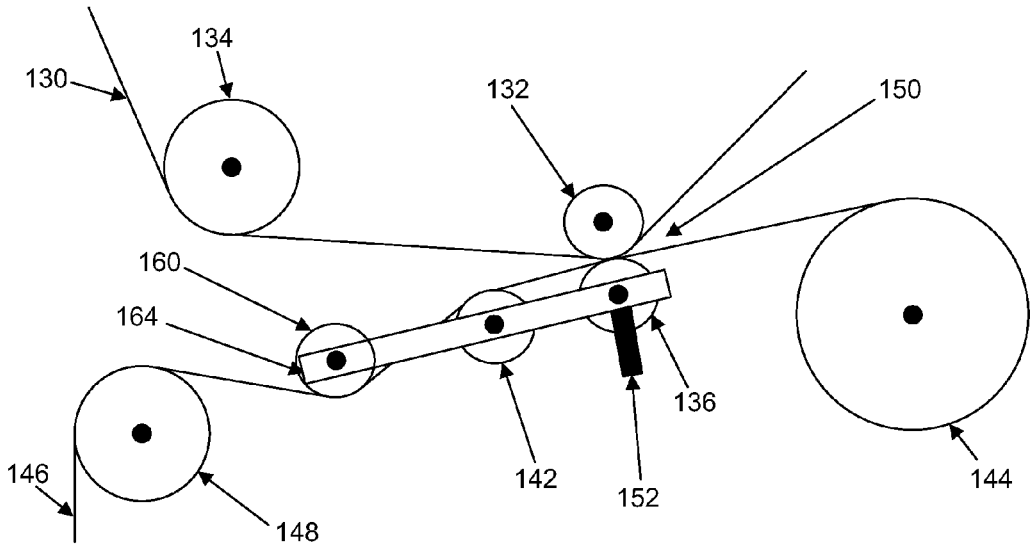
FIG. 4 is a side-view schematic diagram of a device according to embodiments herein.
Figure 5:
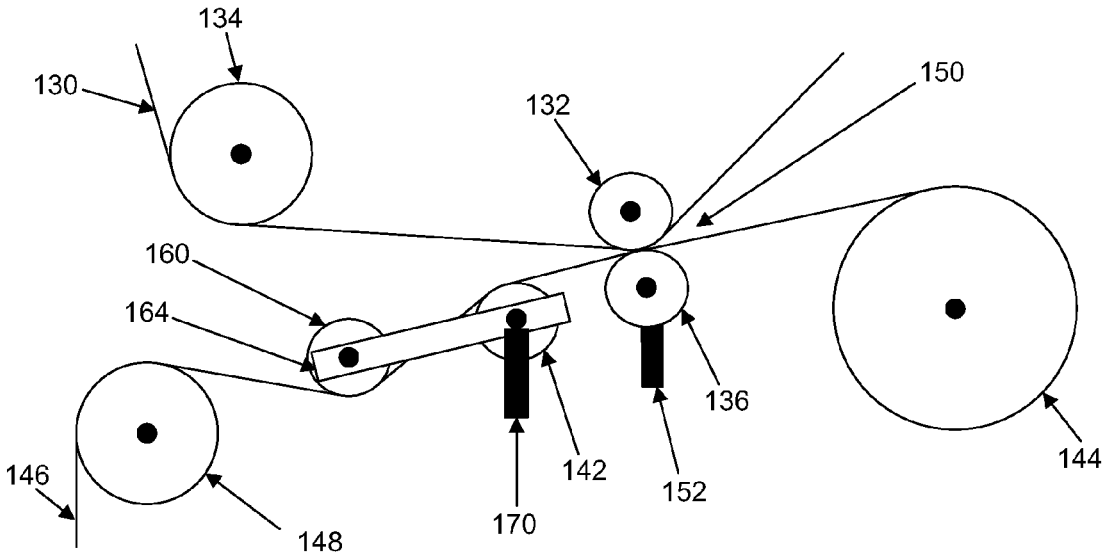
FIG. 5 is a side-view schematic diagram of a device according to embodiments herein.

As shown in FIG. 4, in other embodiments, the physical link 164 can also be connected to the movable transfer roller 136, eliminating the need for the cam 140. Alternatively, as shown in FIG. 5, a second actuator 170 can be connected to the physical link 164 or the support roller 142, again eliminating the need for the cam 140.

Figure 6:
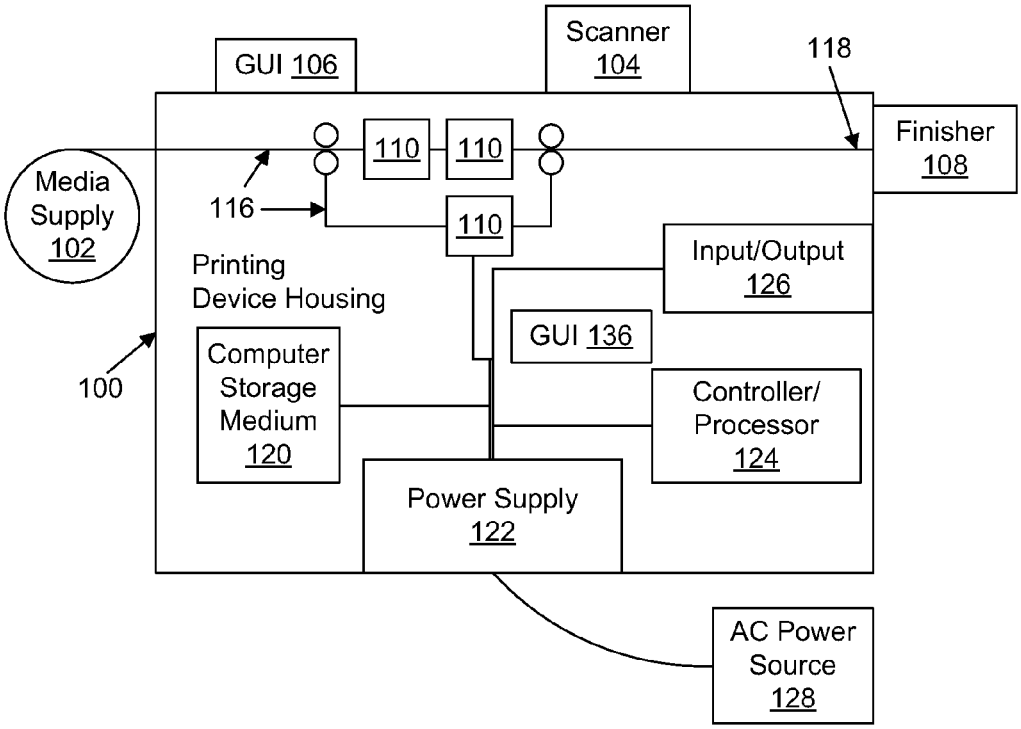
FIG. 6 is a side-view schematic diagram of a device according to embodiments herein.

FIG. 6 illustrates a computerized printing device 100, which can be used with embodiments herein and can comprise, for example, a printer, copier, multi-function machine, etc. The printing device 100 includes a controller/processor 124, at least one marking device (printing engines) 110 operatively connected to the processor 124, a media path 116 positioned to supply print media from a media supply 102 to the marking device(s) 110, and a communications port (input/output) 126 operatively connected to the processor 124 and to a computerized network external to the printing device. The printing engines 110 shown in FIG. 6 can include the structures shown in FIGS. 1-5 above, and provide the advantages discussed above.

After receiving various markings from the printing engine (s), the print media can optionally pass to a finisher 108 which can roll, cut, fold, staple, sort, etc., the printed media. Also, the printing device 100 can include at least one accessory functional component (such as a scanner/document handler 104, media supply 102, finisher 108, etc.) and graphic user interface assembly 106 that also operate on the power supplied from the external power source 128 (through the power supply 122).

The input/output device 126 is used for communications to and from the multi-function printing device 100. The processor 124 controls the various actions of the printing device. A non-transitory computer storage medium device 120 (which can be optical, magnetic, capacitor based, etc.) is readable by the processor 124 and stores instructions that the processor 124 executes to allow the multi-function printing device to perform its various functions, such as those described herein.

Thus, a printer body housing 100 has one or more functional components that operate on power supplied from the alternating current (AC) 128 by the power supply 122. The power supply 122 connects to an external alternating current power source 128 and converts the external power into the type of power needed by the various components.

As would be understood by those ordinarily skilled in the art, the printing device 100 shown in FIG. 6 is only one example and the embodiments herein are equally applicable to other types of printing devices that may include fewer components or more components. For example, while a limited number of printing engines and paper paths are illustrated in FIG. 6, those ordinarily skilled in the art would understand that many more paper paths and additional printing engines could be included within any printing device used with embodiments herein.

Many computerized devices are discussed above. Computerized devices that include chip-based central processing units (CPUs), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. An apparatus comprising:

a photoreceptor belt;

a fixed transfer roller positioned on a first side of said photoreceptor belt;

a movable transfer roller positioned on a second side of said photoreceptor belt opposite said first side, said fixed transfer roller and said movable transfer roller being positioned to form a nip, said photoreceptor belt and a web of print media being positioned in said nip;

a support roller contacting said web of print media;

a compensation roller contacting said web of print media, said support roller being positioned between said compensation roller and said nip; and a physical link connected to said compensation roller, said physical link simultaneously moving said compensation roller as said movable transfer roller moves.

2. The apparatus according to claim 1, said support roller and said compensation roller being on one of the same side and the opposite sides of said web of print media depending on the tension compensation requirement.

3. The apparatus according to claim 1, said physical link moving said support roller and said compensation roller in a first direction away from said photoreceptor belt and in a second direction toward from said photoreceptor belt.

4. The apparatus according to claim 1, said physical link comprising a bar connected to axis of said support roller and said compensation roller.

5. The apparatus according to claim 1, said support roller being approximately centered between said compensation roller and said nip.

6. An apparatus comprising:

a photoreceptor belt;

a fixed transfer roller positioned on a first side of said photoreceptor belt;

a movable transfer roller positioned on a second side of said photoreceptor belt opposite said first side, said fixed transfer roller and said movable transfer roller being positioned to form a nip, said photoreceptor belt and a web of print media being positioned in said nip;

a support roller contacting said web of print media;

a compensation roller contacting said web of print media, said support roller being positioned between said compensation roller and said nip; and a physical link connected to said support roller and said compensation roller, said physical link simultaneously moving said support roller and said compensation roller as said movable transfer roller moves.

7. The apparatus according to claim 6, said support roller and said compensation roller being on one of the same side and opposite sides of said web of print media depending on the tension compensation requirement.

8. The apparatus according to claim 6, said physical link moving said support roller and said compensation roller in a first direction away from said photoreceptor belt and in a second direction toward from said photoreceptor belt.

9. The apparatus according to claim 6, said physical link comprising a bar connected to axis of said movable transfer roller, said support roller, and said compensation roller.

10. The apparatus according to claim 6, said support roller being approximately centered between said compensation roller and said nip.

11. An apparatus comprising:

a photoreceptor belt;

a fixed transfer roller positioned on a first side of said photoreceptor belt;

a movable transfer roller positioned on a second side of said photoreceptor belt opposite said first side, said fixed transfer roller and said movable transfer roller being positioned to form a nip, said photoreceptor belt and a web of print media being positioned in said nip;

an actuator connected to and moving said movable transfer roller;

a support roller contacting said web of print media;

a cam contacting said movable transfer roller and said support roller, said cam causing said support roller to move as said actuator moves said movable transfer roller;

a compensation roller contacting said web of print media, said support roller being positioned between said compensation roller and said nip; and a physical link connected to said support roller and said compensation roller, said physical link simultaneously moving said compensation roller as said support roller moves.

12. The apparatus according to claim 11, said support roller and said compensation roller being on opposite sides of said web of print media.

13. The apparatus according to claim 11, said physical link moving said support roller and said compensation roller in a first direction away from said photoreceptor belt and in a second direction toward from said photoreceptor belt.

14. The apparatus according to claim 11, said physical link comprising a bar connected to axis of said support roller and said compensation roller.

15. The apparatus according to claim 11, said support roller being approximately centered between said compensation roller and said nip.

16. An apparatus comprising:

a photoreceptor belt;

a fixed transfer roller positioned on a first side of said photoreceptor belt;

a movable transfer roller positioned on a second side of said photoreceptor belt opposite said first side, said fixed transfer roller and said movable transfer roller being positioned to form a nip, said photoreceptor belt and a web of print media being positioned in said nip;

an actuator connected to and moving said movable transfer roller;

a support roller contacting said web of print media;

a compensation roller contacting said web of print media, said support roller being positioned between said compensation roller and said nip; and a physical link connected to said movable transfer roller, said support roller, and said compensation roller, said physical link simultaneously moving said support roller and said compensation roller as said actuator moves said movable transfer roller.

17. The apparatus according to claim 16, said support roller and said compensation roller being on opposite sides of said web of print media.

18. The apparatus according to claim 16, said physical link moving said movable transfer roller, said support roller, and said compensation roller in a first direction away from said photoreceptor belt and in a second direction toward from said photoreceptor belt.

19. The apparatus according to claim 16, said physical link comprising a bar connected to axis of said movable transfer roller, said support roller, and said compensation roller.

20. The apparatus according to claim 16, said support roller being approximately centered between said compensation roller and said nip.

* * * * *